US010391653B2

(12) United States Patent
Lessmann et al.

(10) Patent No.: US 10,391,653 B2
(45) Date of Patent: Aug. 27, 2019

(54) SAFETY RAZOR AND BLADE UNIT FOR SAFETY RAZOR

(71) Applicant: BEIERSDORF AG, Hamburg (DE)

(72) Inventors: Michael Lessmann, Hamburg (DE); Jens Treu, Hamburg (DE); Kesen Zeng, Hamburg (DE); Yvonne Neumann, Hamburg (DE); Hiroyuki Nakasuka, Gifu (JP); Ralf Hagens, Hamburg (DE); Philip Drescher, Hamburg (DE)

(73) Assignee: BEIERSDORF AG, Hamburg (DE)

( * ) Notice: Subject to any disclaimer, the term of this patent is extended or adjusted under 35 U.S.C. 154(b) by 0 days.

(21) Appl. No.: 15/328,936

(22) PCT Filed: Apr. 27, 2015

(86) PCT No.: PCT/EP2015/059068

§ 371 (c)(1),
(2) Date: Jan. 25, 2017

(87) PCT Pub. No.: WO2016/015882

PCT Pub. Date: Feb. 4, 2016

(65) Prior Publication Data

US 2017/0232625 A1 Aug. 17, 2017

(30) Foreign Application Priority Data

Jul. 31, 2014 (EP) ..... 14179264

(51) Int. Cl.
*B26B 21/44* (2006.01)
*B26B 21/52* (2006.01)
(Continued)

(52) U.S. Cl.
CPC ..... *B26B 21/443* (2013.01); *B26B 21/06* (2013.01); *B26B 21/227* (2013.01);
(Continued)

(58) Field of Classification Search
CPC ... Y10T 83/04; B26B 21/443; B26B 21/4068; B26B 21/06; B26B 21/227;
(Continued)

(56) References Cited

U.S. PATENT DOCUMENTS 6,185,823 B1 2/2001 Brown et al.
6,216,345 B1 4/2001 Andrews
7,103,976 B2 * 9/2006 Pennella ..... B26B 21/44 30/32
D542,972 S * 5/2007 Pryor ..... D28/47
7,877,879 B2 * 2/2011 Nakasuka ..... B26B 21/44 30/41
(Continued)

FOREIGN PATENT DOCUMENTS

CN 201329599 Y 10/2009
EP 2711146 A1 3/2014
(Continued)

*Primary Examiner* — Ghassem Alie
(74) *Attorney, Agent, or Firm* — Abel Schillinger, LLP

(57) ABSTRACT

Embodiments of the invention include a blade unit for a safety razor, comprising: a connecting structure configured to fix the blade unit to a handle; a blade housing comprising a plurality of blades having respective cutting edges lying in a shaving plane and being arranged to exert a cutting action when moved across a user's skin in a shaving direction; and a rear portion arranged next to the plurality of blades in the shaving direction, comprising a non-flexible concave back portion that arcuately bends away from the shaving plane, and a convex lubricating pad arranged on and being supported by the non-flexible concave back portion and which extends up to a rear edge of the rear portion of the blade unit.

20 Claims, 7 Drawing Sheets

(51) Int. Cl.
*B26B 21/22* (2006.01)
*B26B 21/40* (2006.01)
*B26B 21/06* (2006.01)

(52) U.S. Cl.
CPC ..... *B26B 21/4012* (2013.01); *B26B 21/4018* (2013.01); *B26B 21/4025* (2013.01); *B26B 21/4068* (2013.01); *B26B 21/44* (2013.01); *B26B 21/521* (2013.01)

(58) Field of Classification Search
CPC ..... B26B 21/521; B26B 21/4012; B26B 21/4018; B26B 21/225; B26B 21/00–10; B26B 21/14; B26B 21/16; B26B 21/4034; B26B 21/522
USPC ..... 30/50, 47–51, 55, 74.1, 77, 344.05, 41, 30/537, 838, 84, 75, 73, 79, 526, 540; D28/47
See application file for complete search history.

(56) References Cited

U.S. PATENT DOCUMENTS

| | | | | |
|---|---|---|---|---|
| D698,999 | S * | 2/2014 | Otsuka | D28/47 |
| 9,498,892 | B2 | 11/2016 | Nakasuka et al. | |
| 9,517,570 | B2 * | 12/2016 | Tucker | B26B 21/4031 |
| 2005/0022386 | A1 | 2/2005 | Macove | |
| 2005/0278954 | A1 * | 12/2005 | Orloff | B26B 21/227 30/32 |
| 2006/0080837 | A1 * | 4/2006 | Johnson | B26B 21/44 30/50 |
| 2008/0209734 | A1 * | 9/2008 | Nicoll | B26B 21/222 30/41 |
| 2011/0126413 | A1 | 6/2011 | Szczepanowski et al. | |
| 2014/0096402 | A1 | 3/2014 | Nakasuka et al. | |

FOREIGN PATENT DOCUMENTS

| | | | | |
|---|---|---|---|---|
| JP | 2014090932 A * | 5/2014 | | B26B 21/225 |
| WO | WO 2012/157624 A1 * | 11/2018 | | B26B 21/225 |

* cited by examiner

SAFETY RAZOR AND BLADE UNIT FOR SAFETY RAZOR

FIELD

Embodiments described herein relate to safety razors and blade units for safety razors.

BACKGROUND

Safety razors are typically composed of a blade unit connected, either detachably or fixedly (permanently fixed or integrated), to a handle. Blade units are known which have one or more blades, often a plurality of parallel blades, each defining a cutting edge, with blade unit elements positioned in front of and behind (rear of) the cutting edge(s) (referred to as a "guard" and a "cap", respectively) in a shaving direction. A shaving aid, such as a lubricating strip, is often incorporated in one or both of these blade unit elements to improve shaving performance and lubricating treatment of the user's skin.

The shape of the blade unit can affect shaving performance. For example, while blade units having a rectangular, planar and/or block-type shape provide good performance for shaving relatively flat, large skin surface areas, their use for shaving more contoured, smaller, narrower skin surface areas such as those around the ankles, behind the knees and under the arms, can be more problematic.

It would be desirable to provide an improved blade unit.

SUMMARY OF THE INVENTION

One aspect provides a blade unit for a safety razor, comprising: a connecting structure configured to fix the blade unit to a handle; a blade housing comprising a plurality of blades having respective cutting edges lying in a shaving plane and being arranged to exert a cutting action when moved across a user's skin in a shaving direction; and a rear portion arranged next to the plurality of blades in the shaving direction, comprising a non-flexible concave back portion that arcuately bends away from the shaving plane, and a convex lubricating pad arranged on and being supported by the non-flexible concave back portion and which extends up to a rear edge of the rear portion of the blade unit.

The provision of a convex lubricating pad and a concave back portion, i.e., the provision of a lubricating pad that is curved to conform to the arcuate shape of a supporting back portion on which the lubricating pad is arranged, results in a blade unit that has a relatively large skin-contacting surface and yet is of compact design, to allow effective shaving of, for example, contoured (e.g., curved) skin surface areas such as those around the ankles, behind the knees and under the arms. Also to that end, the radius of curvature of the convex lubricating pad can be set to about 10 mm, which is within a preferred range from 5 to 20 mm. Although the lubricating pad is in a fixed positional relationship relative to the non-flexible concave back portion, the lubricating pad can be deformed by, for example, a compressive force. The lubricating pad can return substantially to its shape prior to deformation.

Preferably, no separate element (e.g., no separate frame) is provided around an outer perimeter of the blade unit for fixing the elements of the blade unit (such as the blade housing and the rear portion, and in particular, the lubricating pad and the non-flexible concave back portion) to each other, as such elements are, for example, adhered, integrated, bonded and/or otherwise attached to each other.

Thus, the size of the skin-contacting surface can be maximised while keeping the size and volume of the blade unit in a reasonable format and no frame edges may disturb the shaving process on the user's skin.

In one embodiment, the convex lubricating pad meets flush with the non-flexible concave back portion at the rear edge. The provision of a smooth, lubricated rear edge helps the blade unit glide over skin surface areas during shaving.

In one embodiment, the convex lubricating pad is curved in an arc shape along the rear edge. This allows the blade unit to easily turn and follow the contours of skin surface areas.

In one embodiment, the non-flexible concave back portion comprises a straight member and an arched member that are connected to each other at respective ends so as to define at least one gap in which part of the convex lubricating pad is disposed. In this way, the lubricating pad can be fixed (for example, adhered) to the back portion in a straightforward manner.

In one embodiment, the blade unit further comprises: a forward portion arranged next to the plurality of blades in the shaving direction on an opposite side of the rear portion, comprising a non-flexible back portion extending parallel to the shaving plane, and an elongate lubricating strip arranged on and being supported by the non-flexible back portion and which extends up to a front edge of the forward portion of the blade unit. A skin-contacting surface area of the convex lubricating pad can be greater than a skin-contacting surface area of the elongate lubricating strip. The provision of an elongate lubricating strip on the front edge of the blades provides delivery of lubricant to the skin shortly before the cutting edges of the blades move across the skin during the shaving process, while minimising clogging of the blades.

Herein, the term "rear" is used to describe features of the blade unit that are positioned behind the blades when the blade unit is drawn across the skin, while the term "forward" is used to describe features of the blade unit that are positioned in front the blades when the blade unit is drawn across the skin. The term "front" is used to describe features of the blade unit that are positioned on the skin-contacting side of the blade unit (i.e., on a front-side of the blade unit), and the term "back" is used to describe features of the blade unit that are positioned on a side opposite the skin-contacting side of the blade unit (i.e., on a back-side of the blade unit).

In one embodiment, the rear portion of the blade unit and the forward portion of the blade unit are connected by side portions of the blade unit, to define a supporting structure for the blade housing. Such a supporting structure offers control of the blade housing during shaving. The supporting structure can be molded from resin.

In one embodiment, the convex lubricating pad and elongate lubricating strip extend along at least 60%, and preferably at least 80%, of an outer perimeter of the blade unit when viewed from a direction perpendicular onto the shaving plane. Covering a majority of an outer perimeter with lubricating elements reduces friction between the blade unit and the skin, helping to prevent minor cuts and pulling/tugging (as opposed to cutting) of hair.

In one embodiment, the convex lubricating pad extends along at least 30%, and preferably at least 40%, of an outer perimeter of the blade unit when viewed from a direction perpendicular onto the shaving plane. This helps to treat the skin after encountering the blades.

In one embodiment, the skin-contacting surface of the lubricating pad is provided with a recess. Moisture can be retained in such a recess, so that lubricity is increased.

In one embodiment, the lubricating pad is integrally attached to the rear portion of the blade unit by injection molding. The lubricating pad comprises an elastic material such as, for example, a molded material including a water-soluble component (e.g., water-soluble polyethylene oxide) and a water-insoluble component (e.g., soft plastic such as elastomer resin as an elastic material). This allows the flexible portion to be easily elastically deformed. The weight proportion of the soft resin in the water-soluble component in relation to the weight of the entire lubricating pad can be set larger than the weight proportion of the water-soluble component in relation to the weight of the entire lubricating pad. For example, the elastomer resin can be set to have a weight proportion of not less than 30% such as, for example, a weight proportion of 50% or larger, and the water-soluble component can be set to have a weight proportion of not more than 50% such as, for example, a weight proportion of 15%. The lubricating strip can be injection-molded to the forward portion together and simultaneously with the lubricating pad of the rear portion.

One aspect provides a safety razor, comprising: the aforementioned blade unit; and a handle having a proximal portion to which the blade unit is fixed and a distal portion. The blade unit can be detachably connected or fixedly connected (permanently fixed or integrated) to the handle. The safety razor can include a pivoting mechanism that allows the blade unit to pivot with respect to the handle. The pivoting mechanism can allow the blade unit to pivot in any of three dimensional directions. In some embodiments, the pivoting mechanism can allow the blade unit to most easily pivot upwards.

In one embodiment, the proximal portion arcuately bends away from the shaving plane. Such a configuration permits the blade unit to pivot backwards over a large angular range, that is without the blade unit being impaired by (hitting against) the handle during use. Also to that end, the connecting structure can be provided on the back side of the blade unit opposite to the forward portion.

In one embodiment, the proximal portion comprises a non-flexible annular rim surrounding a flexible elastic portion to which the connecting structure is attached. This allows the connecting structure, and thereby the blade unit, to pivot.

The flexible elastic portion may have various configurations to allow, among other things, the connecting structure, and thereby the blade unit, to pivot easily backwards but to resist pivoting forwards. In one embodiment, the flexible elastic portion has a stepped shape in cross-section. In one embodiment, the connecting structure is at an off-centered position of the flexible elastic portion relative to the non-flexible annular rim. In one embodiment, a rear portion of the flexible elastic portion which is opposite the rear portion of the blade unit is wider than a front portion of the flexible elastic portion which is opposite the forward portion of the blade unit.

One aspect provides a method of manufacturing a blade unit for a safety razor, comprising: providing a connecting structure configured to fix the blade unit to a handle; providing a blade housing comprising a plurality of blades having respective cutting edges lying in a shaving plane and being arranged to exert a cutting action when moved across a user's skin in a shaving direction; and providing a rear portion arranged next to the plurality of blades in the shaving direction comprising a non-flexible concave back portion that arcuately bends away from the shaving plane, and a convex lubricating pad arranged on and being supported by the non-flexible concave back portion and which extends up to a rear edge of the rear portion of the blade unit.

The above indicated aspects and embodiments may be combined with each other to achieve the advantageous effects as described above. Further embodiments, features, and advantages of the invention, as well as the structure and operation of the various embodiments of the invention are described in detail below with reference to the accompanying drawings.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF EMBODIMENTS

The following detailed description refers to the accompanying drawings that illustrate exemplary embodiments consistent with this invention. Other embodiments are possible, and modifications can be made to the embodiments within the spirit and scope of the invention. Therefore, the detailed description is not meant to limit the invention.

Figure 1:
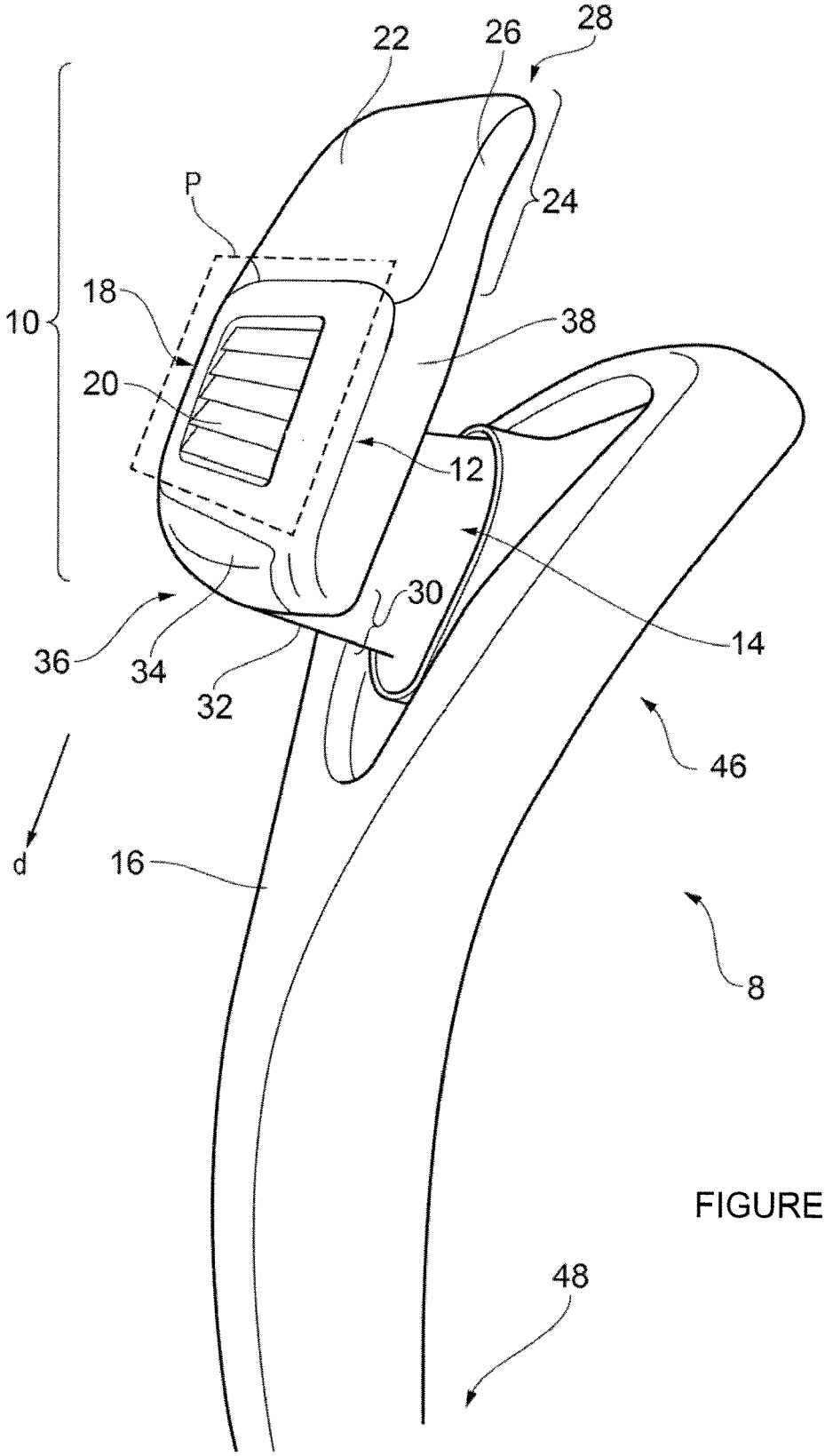
FIG. 1 is a perspective view of a safety razor including a blade unit according to an embodiment.
Figure 2:
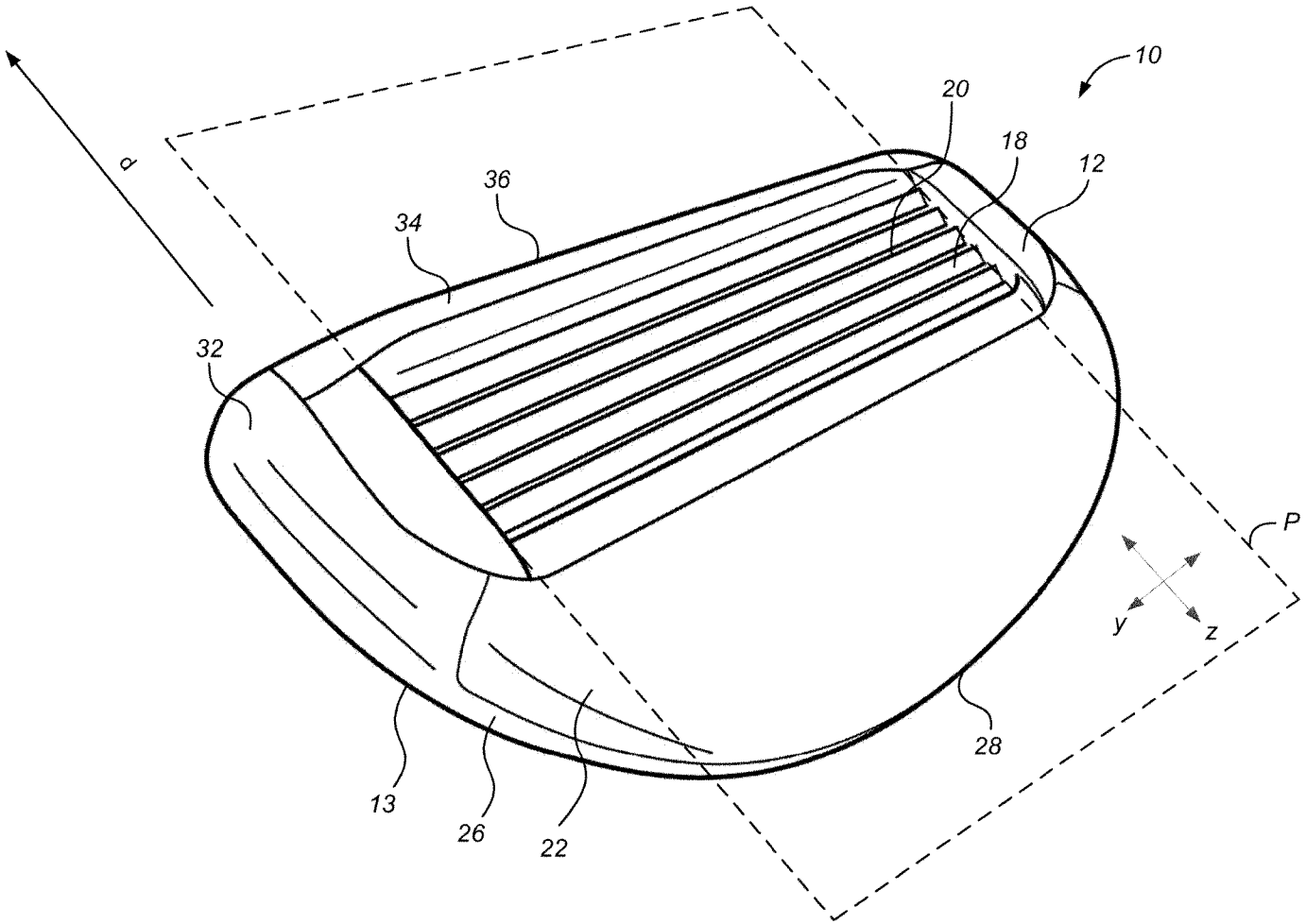
FIG. 2 is a perspective view of the blade unit shown in FIG. 1.
Figure 3:
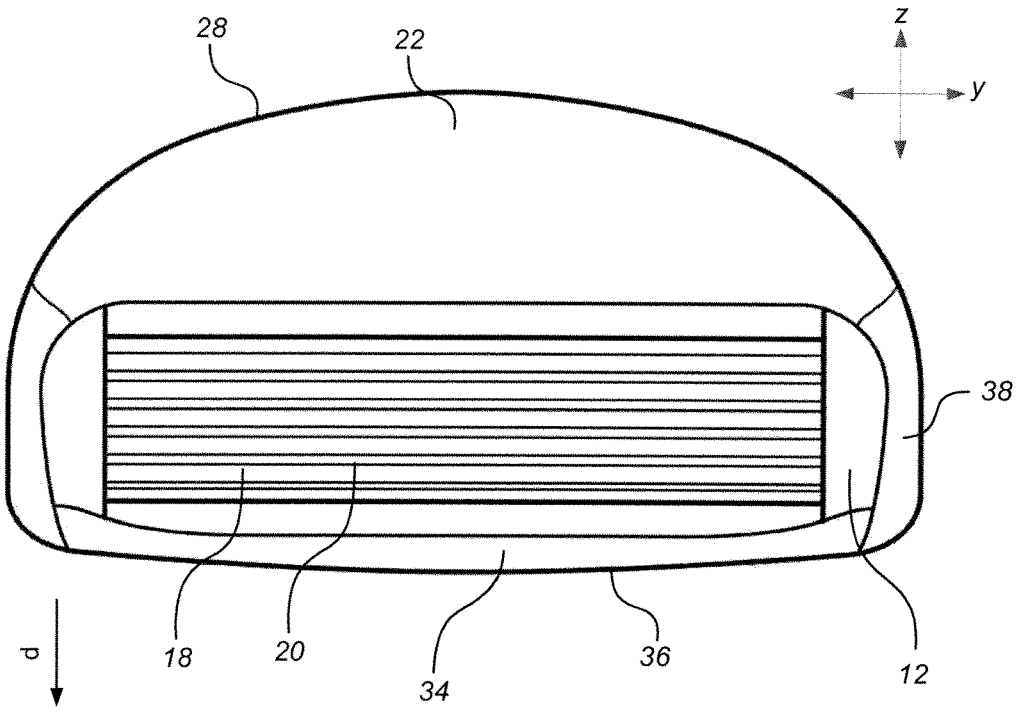
FIG. 3 is a bottom view of the blade unit shown in FIG. 1.
Figure 4:
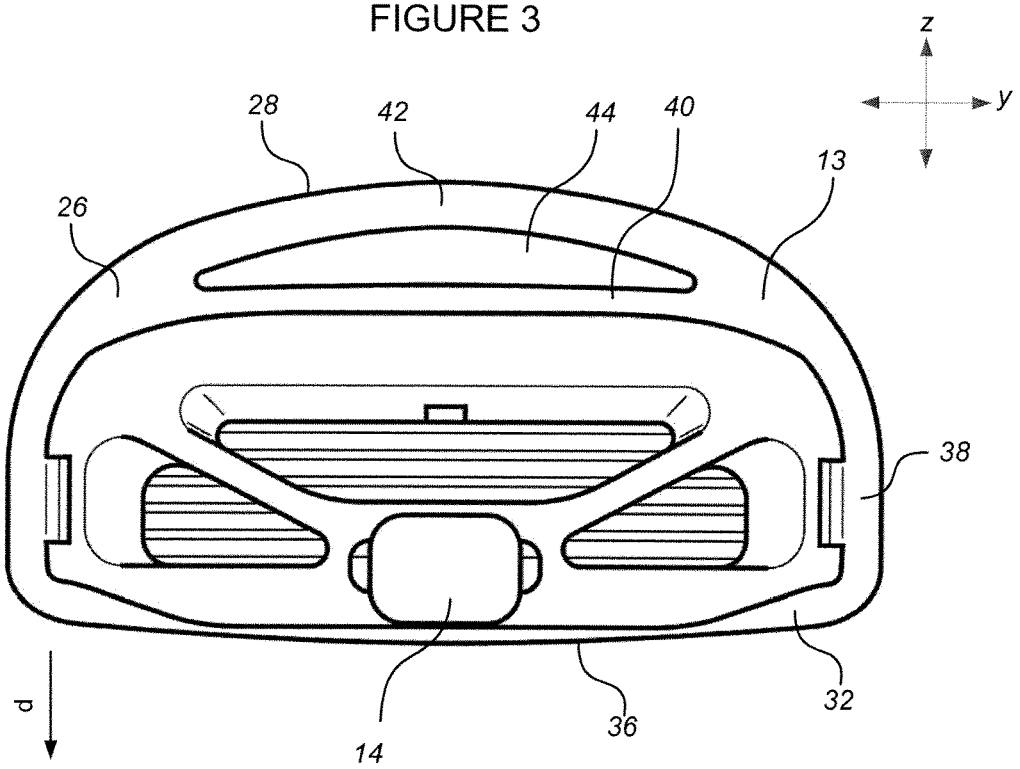
FIG. 4 is a top view of the blade unit shown in FIG. 1.
Figure 5:
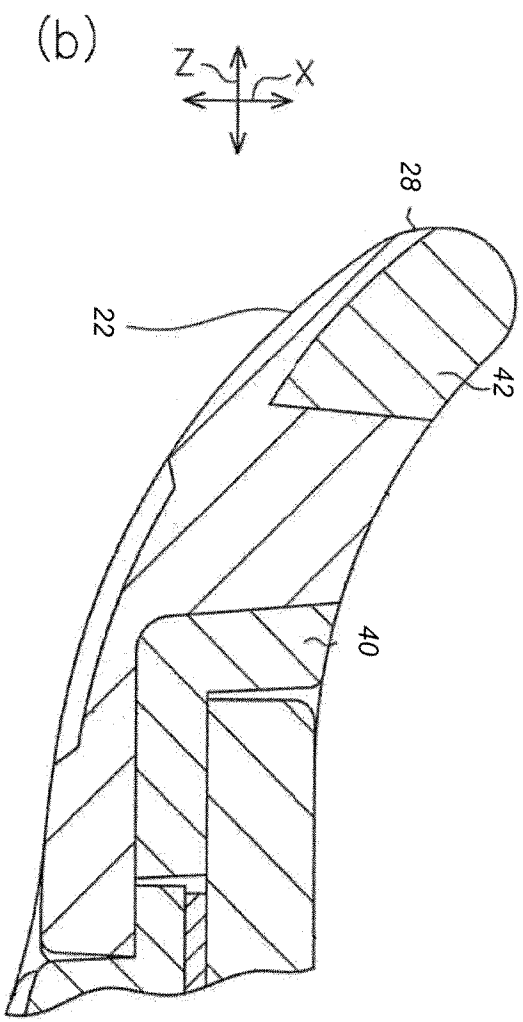
FIGS. 5(*a*) and (*b*) are a cross-sectional view of the rear portion of the blade unit shown in FIG. 1, and a top view of the blade unit and proximal portion of the handle of the razor shown in FIG. 1, respectively.
Figure 5:
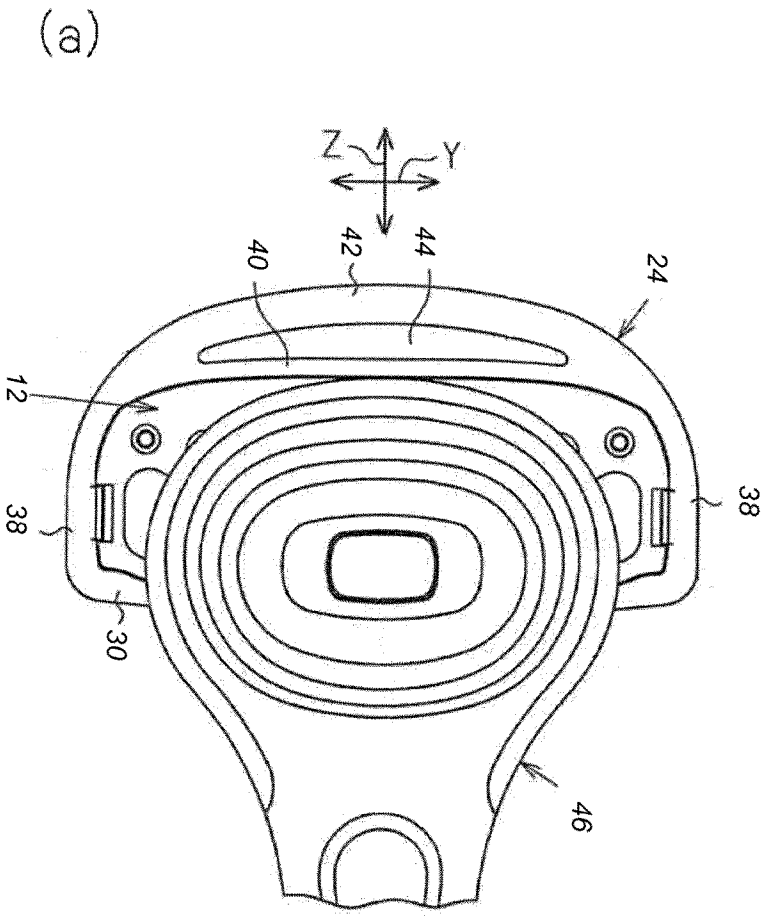
Figure 6:
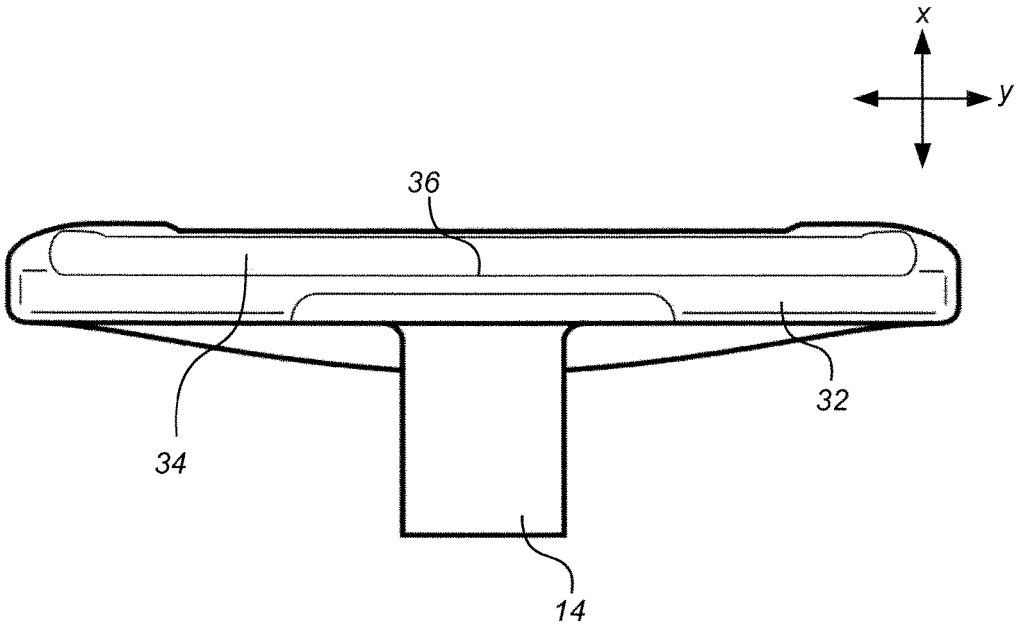
FIG. 6 is a front view of the blade unit shown in FIG. 1.
Figure 7:
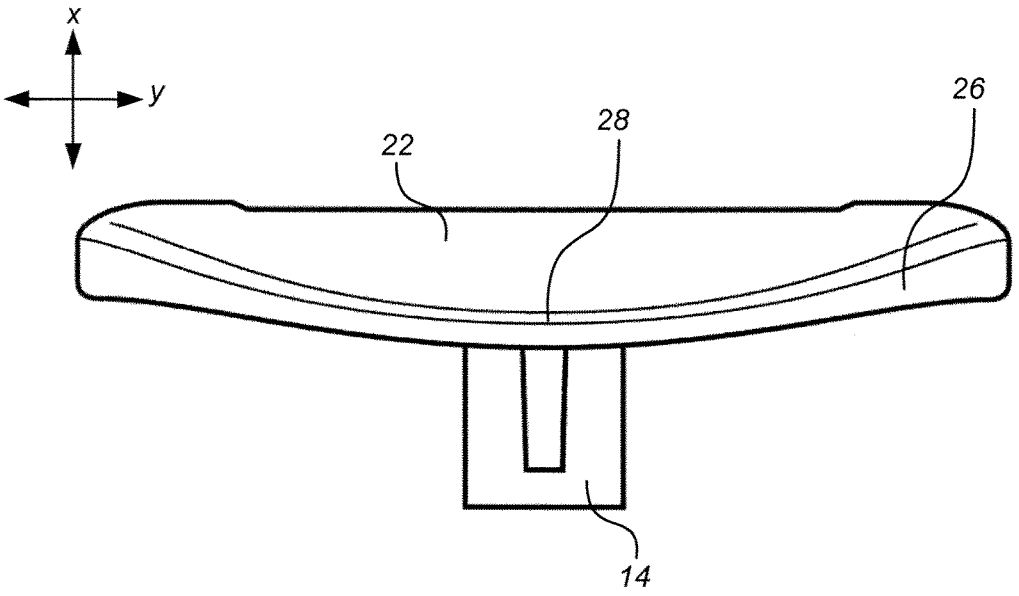
FIG. 7 is a back view of the blade unit shown in FIG. 1.
Figure 8:
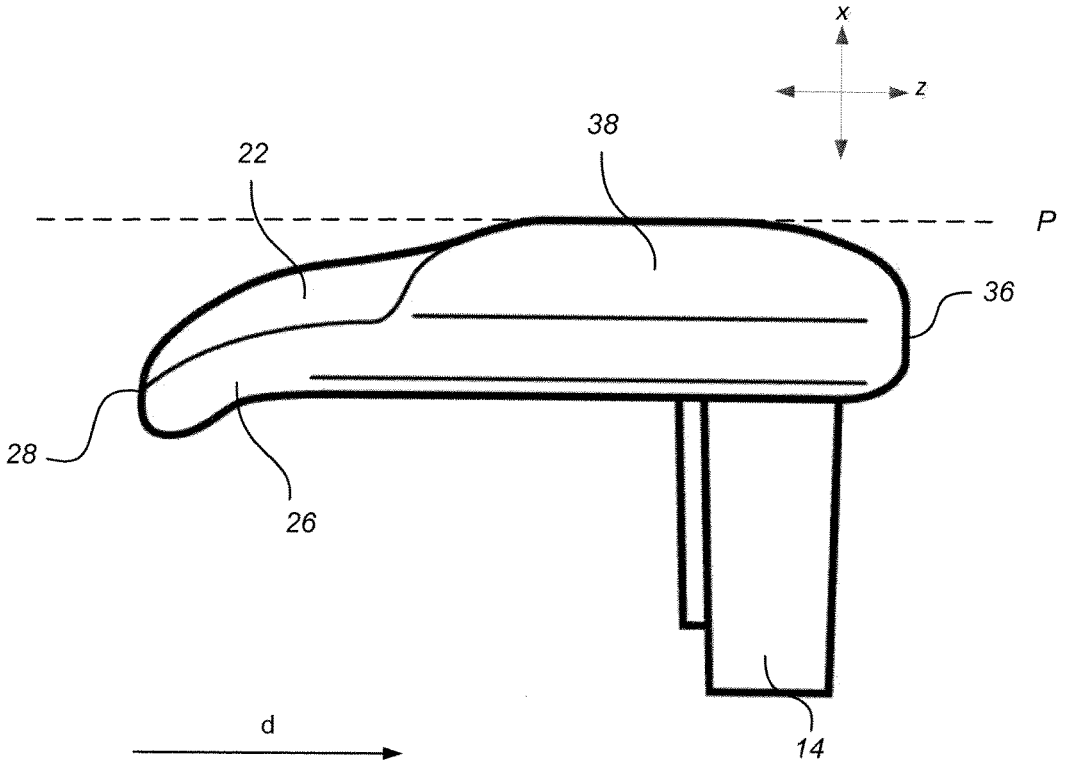
FIG. 8 is a side view of the blade unit shown in FIG. 1.
Figure 9:
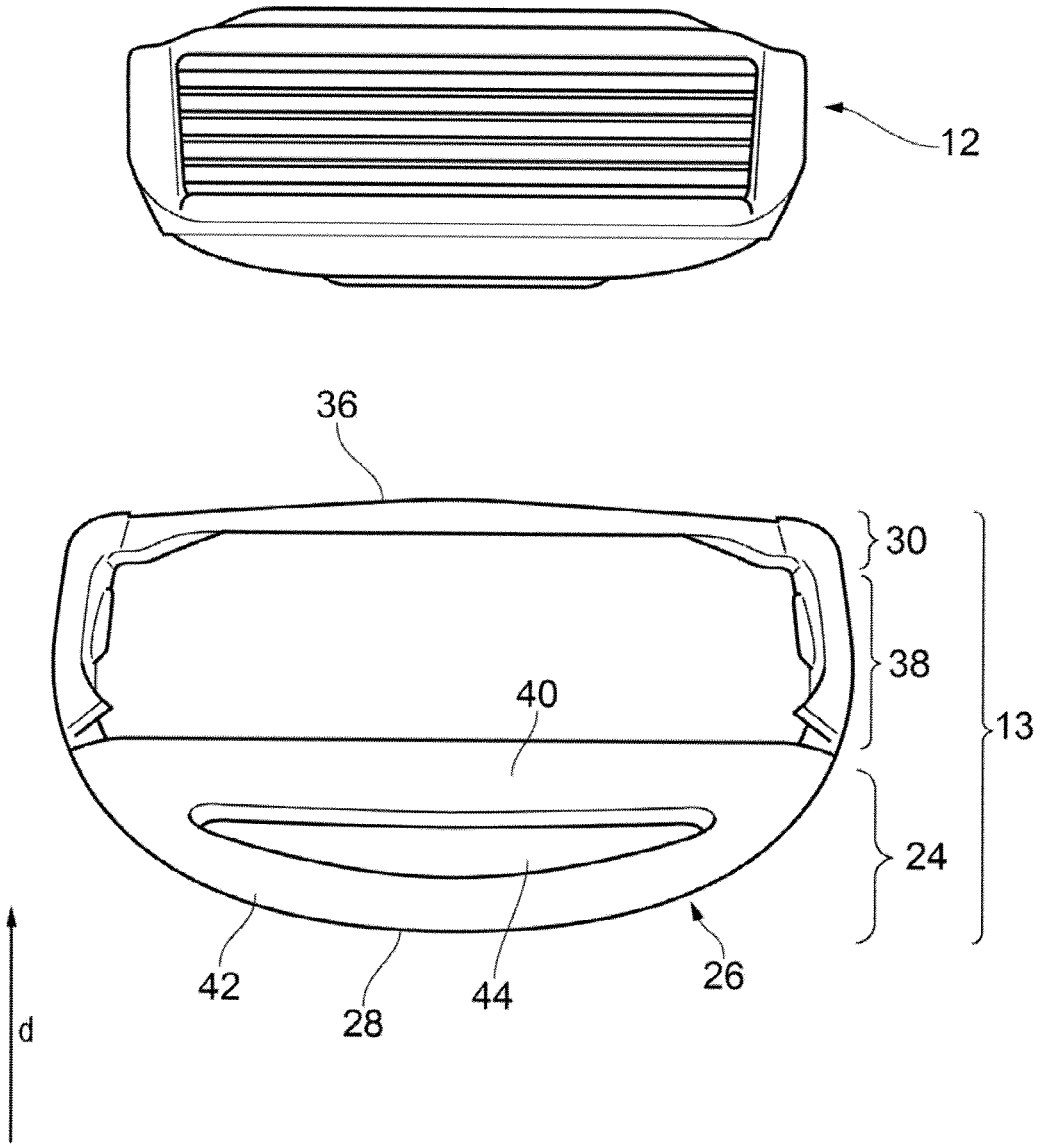
FIG. 9 is a bottom view of parts of the blade unit shown in FIG. 1.

Reference will now be made to FIGS. 1 to 9, which are views of a blade unit and safety razor including the blade unit, according to embodiments. The safety razor 8 has a blade unit 10 and a handle 16 (only a part of which is shown in FIG. 1). The blade unit 10 includes a connecting structure 14 that fixes the blade unit 10 to the handle 16, a blade housing 12 and a supporting structure 13 of the blade housing 12. The blade housing 12 holds a plurality of blades 18 (five blades in this particular case) having respective cutting edges 20 that lie in a shaving plane P. Thus, as used herein, the term "shaving plane" generally refers to the place in which the cutting edges lie. The direction perpendicular to the shaving plane can be referred to as the thickness direction.

The supporting structure 13 comprises a rear portion 24 located behind the blades in a shaving direction d (when assembled) and a forward portion 30 located in front of the blade in the shaving direction d (when assembled). As used herein, the term "shaving direction" signifies the direction in the shaving plane in which the blade unit is intended to be moved. The rear portion 24 and the forward portion 30 are connected by side portions 38. The supporting structure 13 controls the contact of the cutting edges 20 of the blades 18 with the skin during shaving.

The rear portion 24 of the supporting structure 13 comprises a non-flexible concave back portion 26 to which is mounted a convex lubricating pad 22. The terms "concave" and "convex" are employed herein to signify that the lubricating pad has a convex skin-engaging surface and the back portion has a concave surface along the back. The term "non-flexible" means that the concave back portion 26 has rigidity to an extent such that it does not bend during ordinary use of the safety razor 8.

The non-flexible concave back portion 26 comprises a straight member 40 and an arched member 42 that are connected to each other at respective ends, so as to define a gap 44 in which part of the lubricating pad 22 is disposed when mounted thereon. The non-flexible concave back portion 26 and convex lubricating pad 22 meet flush at a rear edge 28 of the rear portion 24 of the blade unit 10 as can be seen from FIG. 1. The lubricating pad 22 is curved in an arc shape that extends along substantially the entire rear edge 28 between the side portions 38.

The front portion 30 of the supporting structure 13 comprises a non-flexible back portion 32 on which is mounted an elongate lubricating strip 34. The non-flexible back portion 32 and elongate lubricating strip 34 meet flush at a front edge 36 of the front portion 30 of the blade unit 10.

The terms "lubricating strip" and "lubricating pad" are used to signify that the length-to-width ratio in the shaving plane, i.e., the ratio of the size in a direction parallel to the blades (length direction) to the size in a direction parallel to the shaving direction d (width direction), of the elongate lubricating strip 34 and the convex lubricating pad 22 are different. In this particular case, the elongate lubricating strip 34 and convex lubricating pad 22 both extend at least along the length of the exposed cutting edges 20 of the blades 18 and have similar length, though the convex lubricating pad 22 is substantially wider than the elongate lubricating strip 34. In this particular case, the elongate lubricating strip 34 has a length-to-width ratio of about 10:1, while the convex lubricating pad 22 has a length to width ratio of about 4:1 at its widest point.

The composition of the lubricating strip/lubricating pad can include a gliding agent. Materials which may be selected as the gliding agent are: PEG-400/1,4-Butanediol/SMDI Copolymer, PEG-115M, PEG 45M, and PEG-5M, or a combination thereof. The composition of the lubricating strip/lubricating pad can include an antioxidant agent, for example Tocopherol. The composition of the lubricating strip/lubricating pad can include an anti-inflammatory agent, for example aloe barbadensis leaf juice. The composition of the lubricating strip/lubricating pad can include a backbone structure. Materials which may be selected as the backbone structure are: styrenic block copolymers and polystyrene, or a combination thereof. Preferably, the composition of the lubricating strip and the composition of the lubricating pad are the same, but this need not be the case.

The handle 16 has a proximal portion 46 closer to the blade unit 10 and a distal portion 48 (not shown in the Figures) farther from the blade unit 10. The connecting structure 14 of the blade unit 10 connects (either fixedly or detachably) to the proximal portion 46 of the handle 16. Thus, the blade unit 10 may be configured for use with a separate handle or may be permanently attached to the handle 16. The proximal portion 46 of the handle 16 also includes a pivot mechanism that allows the blade unit 10 to pivot back-and-forth in a plane perpendicular to the shaving plane P. The pivot mechanism can, of course, allow other pivoting motions such as side-to-side. The proximal portion 46 arcuately bends away from the shaving plane P, to permit the rear portion 24 of the blade unit 10 to pivot backwards, i.e., to bend away from the shaving plane, over a large angular range.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein.

For example, although embodiments are described in which separate lubricating elements, i.e., a lubricating strip and a lubricating pad, are provided, such lubricating elements can be a unitary lubricating element which, for example, covers an area of the supporting structure around the blade housing. Furthermore, the lubricating strip need not be provided at all.

Although embodiments are described in which five parallel blades lying in a shaving plane are provided, the blade housing may comprise more than five blades or fewer than five blades, i.e., the blade housing may comprise at least one blade. When more than one blade is provided, these do not have to lie in a shaving plane, for example the blades could be staggered.

Although embodiments are described in which the shaving aid comprises polymeric material having a lubricating property, the shaving aid may have, either alternatively or in addition, other, e.g., moisturizing, properties considered beneficial during shaving. Furthermore, the shaving aid can take a form other than a pad or a strip. Moreover, the skin-contacting surface of the shaving aid does not have to be smooth but can have, either alternatively or in addition, a finned, holed or other structure.

Although embodiments are described in which the straight and arched member of the rear portion define one, more than one gap can be provided. Furthermore, the rear portion may define one or more recesses instead of a gap.

Although embodiments are described in which the lubricating strip and lubricating pad have particular dimensions, it will be apparent that shaving aids having other dimensions can be employed.

It is to be understood that the phraseology or terminology herein is for the purpose of description and not of limitation, such that the terminology or phraseology of the present specification is to be interpreted by the skilled artisan in light of the teachings and guidance.

For example, expressions such as "perpendicular", "parallel", "conform to" and the like are defined to mean "substantially perpendicular", "substantially parallel" and "substantially conform to". Likewise, the dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "30%" is intended to mean "about 30%".

The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

REFERENCE NUMBERS d shaving direction
P shaving plane
8 safety razor
10 blade unit
12 blade housing
13 supporting structure
14 connecting structure
16 handle
18 blades
20 cutting edges
22 convex lubricating pad
24 rear portion
26 non-flexible concave back portion
28 rear edge
30 forward portion
32 non-flexible back portion
34 elongate lubricating strip
36 front edge
38 side portions
40 straight member
42 arched member
44 gap
46 proximal portion
48 distal portion

What is claimed is:

1. A blade unit for a safety razor, wherein the unit comprises:
- a connecting structure configured to fix the blade unit to a handle;
- a blade housing comprising a plurality of blades having respective cutting edges lying in a shaving plane and being arranged to exert a cutting action when moved across a user's skin in a shaving direction; and
- a rear portion arranged next to the plurality of blades in the shaving direction, comprising
  - a non-flexible concave back portion fixedly connected to a supporting structure for the blade housing, said non-flexible concave back portion arcuately bending away from the shaving plane, and
  - a convex lubricating pad arranged on and being supported by the non-flexible concave back portion and which extends up to a rear edge of the rear portion of the blade unit.

2. The blade unit of claim 1, wherein the convex lubricating pad meets flush with the non-flexible concave back portion at the rear edge.

3. The blade unit of claim 1, wherein the convex lubricating pad is curved in an arc shape along the rear edge.

4. The blade unit of claim 1, wherein the non-flexible concave back portion comprises a straight member and an arched member that are connected to each other at respective ends so as to define at least one gap in which part of the convex lubricating pad is disposed.

5. The blade unit of claim 1, wherein the blade unit further comprises:
- a forward portion arranged next to the plurality of blades in the shaving direction on an opposite side of the rear portion, comprising
- a non-flexible back portion extending parallel to the shaving plane, and
- an elongate lubricating strip arranged on and being supported by the non-flexible back portion and which extends up to a front edge of the forward portion of the blade unit.

6. The blade unit of claim 5, wherein a skin-contacting surface area of the convex lubricating pad is greater than a skin-contacting surface area of the elongate lubricating strip.

7. The blade unit of claim 6, wherein the rear portion of the blade unit and the forward portion of the blade unit are connected by side portions of the blade unit, to define the supporting structure of the blade housing.

8. The blade unit of claim 5, wherein the rear portion of the blade unit and the forward portion of the blade unit are connected by side portions of the blade unit, to define the supporting structure of the blade housing.

9. The blade unit of claim 5, wherein the convex lubricating pad and elongate lubricating strip extend along at least 60% of an outer perimeter of the blade unit when viewed from a direction perpendicular onto the shaving plane.

10. The blade unit of claim 5, wherein the convex lubricating pad and elongate lubricating strip extend along at least 80% of an outer perimeter of the blade unit when viewed from a direction perpendicular onto the shaving plane.

11. The blade unit of claim 1, wherein the convex lubricating pad extends along at least 30% of an outer perimeter of the blade unit when viewed from a direction perpendicular onto the shaving plane.

12. The blade unit of claim 1, wherein the convex lubricating pad extends along at least 40% of an outer perimeter of the blade unit when viewed from a direction perpendicular onto the shaving plane.

13. A safety razor, wherein the safety razor comprises the blade unit of claim 1 and a handle having a proximal portion to which the blade unit is fixed and a distal portion.

14. The safety razor of claim 13, wherein the proximal portion arcuately bends away from the shaving plane.

15. The safety razor of claim 14, wherein the proximal portion comprises a non-flexible annular rim surrounding a flexible elastic portion to which the connecting structure is attached.

16. The safety razor of claim 13, wherein the proximal portion comprises a non-flexible annular rim surrounding a flexible elastic portion to which the connecting structure is attached.

17. The safety razor of claim 16, wherein the flexible elastic portion has a stepped shape in cross-section.

18. The safety razor of claim 17, wherein the connecting structure is at an off-centered position of the flexible elastic portion relative to the non-flexible annular rim.

19. The safety razor of claim 16, wherein the connecting structure is at an off-centered position of the flexible elastic portion relative to the non-flexible annular rim.

20. The blade unit of claim 1, wherein the lubricating pad does not extend beyond the shaving plane.

* * * * *